US005232514A

United States Patent [19]

Van Sciver et al.

[11] Patent Number: 5,232,514

[45] Date of Patent: Aug. 3, 1993

[54] CORROSION-INHIBITING CLEANING SYSTEMS FOR ALUMINUM SURFACES, PARTICULARLY ALUMINUM AIRCRAFT SURFACES

[75] Inventors: Jack H. Van Sciver, Madison; Lawrence Kirschner, Flanders, both of N.J.

[73] Assignee: Church & Dwight Co., Inc., Princeton, N.J.

[21] Appl. No.: 774,465

[22] Filed: Oct. 10, 1991

[51] Int. Cl.[5] ..... B08B 7/00; B08B 7/04

[52] U.S. Cl. ..... 134/26; 134/3; 134/7; 134/42; 252/135; 252/140

[58] Field of Search ..... 252/140, 135; 134/7, 134/3, 42, 26

[56] References Cited

U.S. PATENT DOCUMENTS 4,020,857 5/1977 Rendemonti ..... 134/7
4,174,571 11/1979 Gallant ..... 134/7
4,528,039 7/1985 Rubin et al. ..... 134/2

FOREIGN PATENT DOCUMENTS 9115308 10/1991 World Int. Prop. O. ..... 134/7

*Primary Examiner*—Asok Pal
*Attorney, Agent, or Firm*—Charles B. Barris

[57] ABSTRACT

An alkaline blast cleaning system for aluminum surfaces which avoids discoloring or tarnishing of the aluminum surfaces, is comprised of an alkali metal bicarbonate having a particle size of from about 50 to about 1000 and an aqueous solution of sodium silicate, the sodium silicate having an $SiO_2$:$Na_2O$ ratio of from about 2.44 to about 3.22:1 and being present in the aqueous solution in a corrosion inhibiting concentration of from about 100 to about 1000 ppm., the pH of the solution ranging from about 8.1 to about 8.3.

12 Claims, 7 Drawing Sheets

FIG. 1: CORROSION RATES BY POLARIZATION RESISTANCE
ALUMINUM 7075-T6 IMMERSED IN SOLUTIONS AT 49° C (120° F)

FIG. 2: CORROSION INHIBITION OF 1% ARMEX BLAST MEDIA
ALUMINUM 7075-T6 IMMERSED IN SOLUTIONS AT 49° C (120° F)

FIG. 3: CORROSION INHIBITION OF 10% ARMEX BLAST MEDIA
ALUMINUM 7075-T6 IMMERSED IN SOLUTIONS AT 49° C (120° F)

FIG. 4: CORROSION INHIBITION OF 1% $Na_2CO_3$
ALUMINUM 7075-T6 IMMERSED IN SOLUTIONS AT 49° C (120° F)

FIG. 5: CORROSION INHIBITION OF 10% $Na_2CO_3$
ALUMINUM 7075-T6 IMMERSED IN SOLUTIONS AT 49° C (120° F)

FIG. 6: IMMERSION TEST CORROSION RATES
ALUMINUM 7075-T6 IMMERSED IN SOLUTIONS AT 71° C (160° F)
CORROSION RATE (Mils/Year)
0
10
20
30
40
50
60
70
67.4
57.3
4.9
3.2
3.1
2.8
1.8
0.5
0.4
0.03
A
B
C
D
E
F
G
H
I
J
SOLUTIONS

CORROSION-INHIBITING CLEANING SYSTEMS FOR ALUMINUM SURFACES, PARTICULARLY ALUMINUM AIRCRAFT SURFACES

BACKGROUND OF THE INVENTION

I. Field of the Invention

This invention relates to an alkaline blast cleaning system for aluminum surfaces which minimizes or eliminates discoloring or tarnishing of the aluminum surfaces. The invention further relates to processes for using the system in cleaning aluminum surfaces without causing significant discoloring or tarnishing of the aluminum.

More specifically, the invention concerns the use of small amounts of an alkali metal silicate, preferably sodium silicate, in conjunction with alkali metal bicarbonates, particularly sodium bicarbonate, in blast cleaning systems to substantially reduce or altogether prevent alkali attack on aluminum, particularly aircraft aluminum. The present invention also particularly relates to an improved method for cleaning or stripping paint from the exterior surface of aircraft by blasting sodium bicarbonate inhibited with sodium silicate against the aircraft's exterior surfaces.

II. The Prior Art

Until recently, stripping of paint from the exterior surfaces of airplanes was accomplished by use of methylene chloride or formic acid stripping products or solutions. In practice, the airplane would be wheeled into a hangar, and the door to the hangar closed. The workers would don respirators and rubber protective suits and gloves. Then the workers would coat the painted aircraft surfaces with the stripper and subsequently remove the residue with a solvent and repeat the steps as necessary. Upon completion of the paint stripping, the stripped paint and solvent residue would be hosed down the floor drain. Obviously, the whole procedure was hazardous to the workers and the environment. Many states are considering the banning of chemical stripping, leaving sanding by hand as the only approved method for removing paint from airplanes.

Then, it was proposed that sodium bicarbonate be blasted against the painted surfaces by means of pressurized air in order to strip the paint. Although that process avoided the use of ecologically undesirable solvents, the new process produced undesirable clouds of sodium bicarbonate dust. Therefore, it was proposed that a water spray be used with the sodium bicarbonate blasting in order to reduce or eliminate the clouds of sodium bicarbonate dust. We have now found that the system may be inhibited against discoloration or corrosion of aluminum with aqueous sodium silicate solution.

Sodium bicarbonate itself is relatively benign to aircraft aluminum. However, copper-containing alloys of aluminum may darken on contact with bicarbonate/carbonate solutions. Some experts have evaluated the darkening and have the perception that it is the result of the formation of a protective oxide coating, and may well be beneficial. Others in the aircraft industry and among the air fleet owners view the darkening phenomenon as a significant aesthetic or potential corrosion problem. Consequently, we designed our corrosion-inhibiting cleaning systems and process for using them to eliminate or effectively inhibit the possible discoloration problem.

In searching for a way to inhibit or eliminate the potential corrosion problem discussed above, we considered a number of candidate inhibitors. Although potentially effective, many were rejected because of ecological hazards they posed—e.g., chromates. Other inhibitor candidates were used in corrosion tests and found wanting. Upon the completion of our research, we determined that aqueous solutions of sodium silicate at certain concentrations were, surprisingly, the best inhibitor.

It is generally known to treat metal surfaces, e.g., aluminum surfaces, with an aqueous solution of alkali metal silicates, e.g., water glass. The treatments, which include cleaning and/or coating etc., have been done with water glass alone (see, for example, U.S. Pat. Nos. 4,457,322 and 4,528,039) or in conjunction with one or more additives depending on the purpose of the treatment. The patents, which teach the use of one or more additives with the water glass, do not, however, teach the use of bicarbonates in conjunction with the water glass as disclosed in this invention.

Although some patents teach the use of water glass to treat aluminum, none is known which discloses the combination of water glass and bicarbonates, either as a composition, e.g., blast medium, or in a method, to treat aluminum as set forth in this invention.

Rubin et al. U.S. Pat. Nos. 4,457,322 and 4,528,039 disclose that water glass (sodium silicate) alone has been widely used in treating aluminum surfaces. They indicate that a limitation of such a treatment is the inability of water glass to remove certain deposits, due to its low alkalinity. The process proposed to overcome the problem employs an aqueous mixture of an alkali metal metasilicate with sodium-, potassium-, or lithium carbonate, potassium- or sodium orthophosphates or mixtures thereof.

Rubin et al. recognize, as we have found, that certain compositions, e.g., carbonates or orthophosphates, damage and discolor aluminum (see Examples 1,2, 4, 6, 7 and 8). They teach that small concentrations of metasilicate minimizes or prevents their attack on aluminum metal surfaces. The alkali metal carbonates are the only carbonates considered and bicarbonates are not disclosed.

Easton U.S. Pat. No. 4,125,969 is concerned with the wet abrasion blast cleaning of a metallic surface using powdered sodium silicate (water glass) as the abrasive material. The sodium silicate is only partially solubilized when applied, the particulate portion providing the abrasive action. Easton discloses that other active materials may be used with the sodium silicate, e.g., rust inhibitors for ferrous surfaces, etching agents, or certain "surface protection composition" which may be in solution when combined with the sodium silicate. Bicarbonates are not disclosed, however. While the treatment of metal surfaces is discussed, aluminum is not specifically mentioned.

The following three patents teach the use of alkali metal silicates in combination with other components to treat aluminum surfaces.

Seidl U.S. Pat. No. 2,978,361 discloses the use of an alkali metal silicate, e.g., water glass, and at least one other metal, either partially or wholly in the form of its silicate, to coat a metal surface. The coating is especially effective when sprayed on a metal surface which has a high affinity for oxygen, e.g., aluminum.

Duval et al. U.S. Pat. No. 3,458,300 discloses the treatment of aluminum surfaces, e.g., aircraft skin, with a combination of sodium metasilicate with aluminum oxide and a wetting agent.

Etherington et al. U.S. Pat. No. 3,499,780 teaches coating an aluminum substrate, after a brightening step, with a solution comprising an alkali metal silicate, e.g., water glass, and then baking the coating to harden it.

Although the above patents disclose the combination of various agents with water glass, none teaches the use of bicarbonates.

Three patents also disclose the treatment of metal surfaces with alkali metal silicates in combination with other additives. Aluminum surfaces, however, are not specifically referred to. See Curtin U.S. Pat. No. 2,816,195, Ryznar U.S. Pat. No. 3,037,866 and Uhlmann U.S. Pat. No. 3,544,366.

A number of patents disclose the use of mixtures of water glass with sodium bicarbonates, but none is concerned with the treatment of metal, especially aluminum surfaces. See, for example, Imschenetzky U.S. Pat. No. 631,719, Lathe et al. U.S. Pat. No. 2,218,244 and Payne U.S. Pat. No. 4,552,804.

The object of the present invention is to provide a simple but effective corrosion-inhibited blasting means and process for cleaning aluminum surfaces, particularly the aluminum surfaces of airplanes. It is an object of the invention to provide an inhibitor for the blasting media that will reduce the corrosion rate of carbonates on aircraft aluminum to less than that of distilled water. It is another object of the invention to provide an inhibitor for the blasting media that will be safe to handle. It is a still further object of the invention to provide an inhibitor for the blasting media that will be ecologically safe.

SUMMARY OF THE INVENTION

The invention successfully overcomes the potential corrosion problem in the use of sodium bicarbonate blasting to clean aircraft surfaces.

Broadly, the system comprises the use of a solution of an alkali metal silicate in conjunction with an alkali metal bicarbonate chosen from the group consisting of sodium bicarbonate, potassium bicarbonate, lithium bicarbonate, and mixtures thereof. By use of the two kinds of components in conjunction, we mean the use of the two together by the spraying of the two components simultaneously from a spray system or the use of the two components in sequence, with either being used first on the surface to be cleaned. In solution, the silicate is present in a sufficient amount to be effective but not in such an amount as to gel.

More specifically, the invention comprises the use of an aqueous solution of sodium silicate in conjunction with sodium bicarbonate blasting and concurrent water spray. The aqueous solution of sodium silicate may be applied to the aircraft surface to be blasted before or after the sodium bicarbonate blasting and concurrent water spray. The aqueous solution of sodium silicate may be applied concurrently with the use of sodium bicarbonate blasting and concurrent water spray. In fact, the sodium silicate may be used in the water spray used concurrently with the sodium bicarbonate blasting.

The invention provides an alkaline blast cleaning system for aluminum surfaces which avoids discoloring or tarnishing of the aluminum surfaces. The presence of the inhibitor has no deleterious effect on the adhesion of primer and paint subsequently applied to the cleaned aluminum surfaces.

The present invention also provides a process for cleaning aluminum surfaces without causing significant discoloring or tarnishing of the metal surface. The process comprises:

(a) using a pressurized fluid to blast the alkali metal bicarbonate to the aluminum surface to be cleaned, and (b) applying the sodium silicate solution to the aluminum surface.

DETAILED DESCRIPTION OF THE INVENTION

Figure 1:
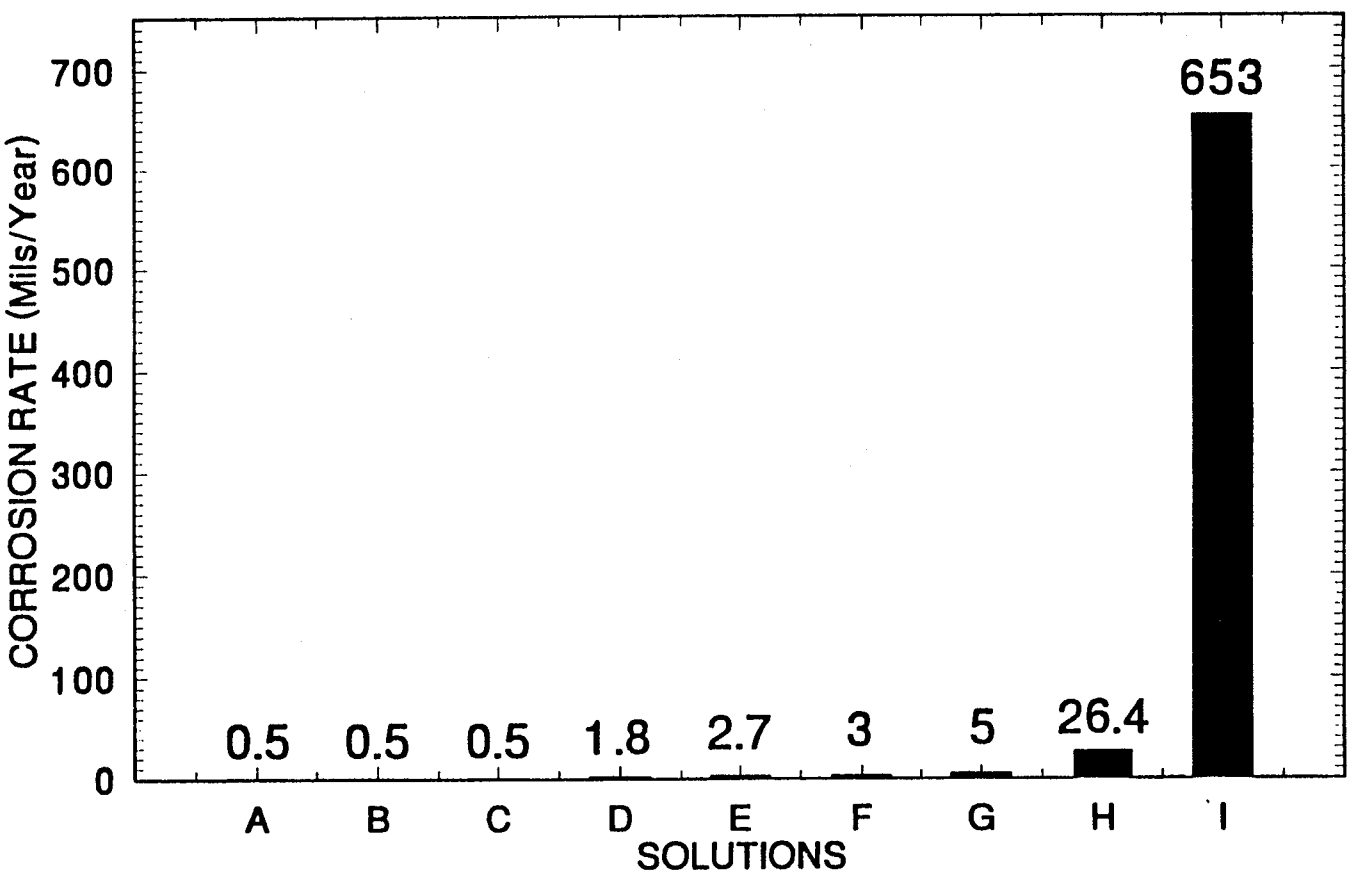
FIG. 1 shows the corrosion rates by polarization resistance for unclad aluminum 7075-T6 alloy immersed in a number of solutions at 49° C. (120° F.).

Alkali metal bicarbonates are the cleaning or paint stripping agents in the cleaning system of the invention. Applied singly, the bicarbonates or their decomposition products, if in solution, even at relatively low concentrations, may alter aluminum and other metal surfaces. Permanent alteration may result ranging from a slight dulling of the metal surface to severe discoloration and some weight loss.

For instance, 1% or higher aqueous sodium bicarbonate may damage aluminum when left in contact with the metal for a sufficient period of time. A 1% sodium bicarbonate solution has a pH of about 8.2. Similarly, a 1% solution of potassium bicarbonate (pH 8.2) will produce discoloration. Higher concentrations will discolor the aluminum more severely.

In view of the aluminum discoloration caused by the above alkaline agents individually, it was unexpected and surprising to find that using bicarbonates in conjunction with solutions containing relatively small concentrations of silicate minimized or altogether prevented the attack on metal surfaces. In fact, the silicate even reduces the corrosion rate of soda ash to below that of distilled water. In addition, the silicate and the bicarbonate do not adversely affect the adhesion of primer and paint subsequently applied to the cleaned aluminum surface.

Although it is easier to handle, easier to dissolve and flows more readily, sodium metasilicate is not acceptable for use in the invention because it has a high pH (about 13) and is therefore dangerous to health and environment.

The system may be comprised of an alkali metal bicarbonate and sodium silicate inhibitor, the sodium silicate having an $SiO_2$:$Na_2O$ ratio of from about 2.44 to about 4.0:1, or more, preferably 3.22, and being present in the aqueous solution in a corrosion inhibiting concentration of from about 100 to about 1000 ppm. Preferred ranges are from about 300 or about 500 to about 1000 ppm. More preferably, the range is from about 300 to about 700 ppm. and most preferably about 500 to about 700 ppm. Aqueous concentrations of sodium silicate of about 500 ppm (pH about 9.5 to 10) are highly preferred. Concentrations lower than 100 ppm are generally not effective, and concentrations greater than 1000 ppm will likely gel. The pH of a solution of an alkali metal silicate, preferably sodium silicate, and an alkali metal bicarbonate, preferably sodium bicarbonate, preferably ranges from about 8.1 to about 8.3.

The concentration of sodium silicate used should be effective, but the concentration should not be so high or the pH so low that gelation occurs. The concentration should be such that there is no adverse reaction with any other component of the blasting system, such as irreversible gelation on the aircraft surface.

Mean particle sizes for the alkali metal bicarbonates may range from approximately 50 to about 1000 microns. Generally, preferred is a range of about 250 to about 300 microns. Finer ranges that are preferred are generally within the range of about 50 to about 100 microns.

Practical application of the present invention may require the presence of optional agents in addition to the alkaline systems described above. Adjunct materials include flow aids such as hydrophobic silica, which may be used to alleviate the tendency of fine particles of bicarbonate to agglomerate in a moist atmosphere, as is found in pressurized air used in blasting. Fluorescent dyes may be used in the process of the invention to determine ingress of the bicarbonate or solution into interstices of the plates and parts of the aircraft when they are later viewed under black light.

According to the present invention there is provided a method for effectively cleaning the exterior surface of aircraft utilizing fluid pressure, particularly air pressure, without deleterious effect to the aircraft. The process of the invention can remove surface corrosion at the same time as it is removing paint or other coatings from the aluminum surfaces.

For the fluid pressure, high pressure water may be used to propel the alkali metal bicarbonate blasting medium optionally along with insolubles, such as sand and other abrasives.

A process for cleaning aluminum surfaces without causing significant discoloring or tarnishing of the aluminum comprises:

(a) using a pressurized fluid to blast an alkali metal bicarbonate to the aluminum surface to be cleaned, and (b) applying an alkali metal silicate solution to the aluminum surface.

A preferred process for stripping paint from the exterior surface of an aircraft comprises the steps of:

(a) prewashing the surface with water or an aqueous solution of a detergent, (b) using a pressurized fluid to blast the alkali metal bicarbonate to the aluminum surface to be cleaned, (c) applying a sodium silicate solution to the aluminum surface, and (d) subsequently rinsing off the aluminum surfaces to remove the residual alkali metal bicarbonate, sodium silicate solution and any matter cleaned from the aluminum surfaces.

A preferred way of conducting the blasting step (b) comprises the substeps of:

(i) containing within a pressure vessel a quantity of blasting medium comprised of fine particles having a mean particle size of from about 50 to about 100 microns;

(ii) pressuring said pressure vessel by providing fluid communication between said pressure vessel and a source of pressurized air;

(iii) feeding said blasting medium from said pressure vessel through an exit conduit to a conveying conduit, said conveying conduit being in fluid communication with said source of pressurized air through an air conduit;

(iv) mixing said blasting medium with the stream of pressurized air flowing within said conveying conduit;

(v) sensing the pressure differential between said pressure vessel and said conveying conduit;

(vi) maintaining said pressure differential at a preselected level so that the pressure level within said pressure vessel is greater than the pressure within said conveying conduit; and (vii) discharging said mixture of blasting medium and said stream of pressurized air through a nozzle at the end of said conveying conduit.

Preferably, the preselected pressure differential is such that it is able to maintain a uniform flow rate through the nozzle.

Figure 7:
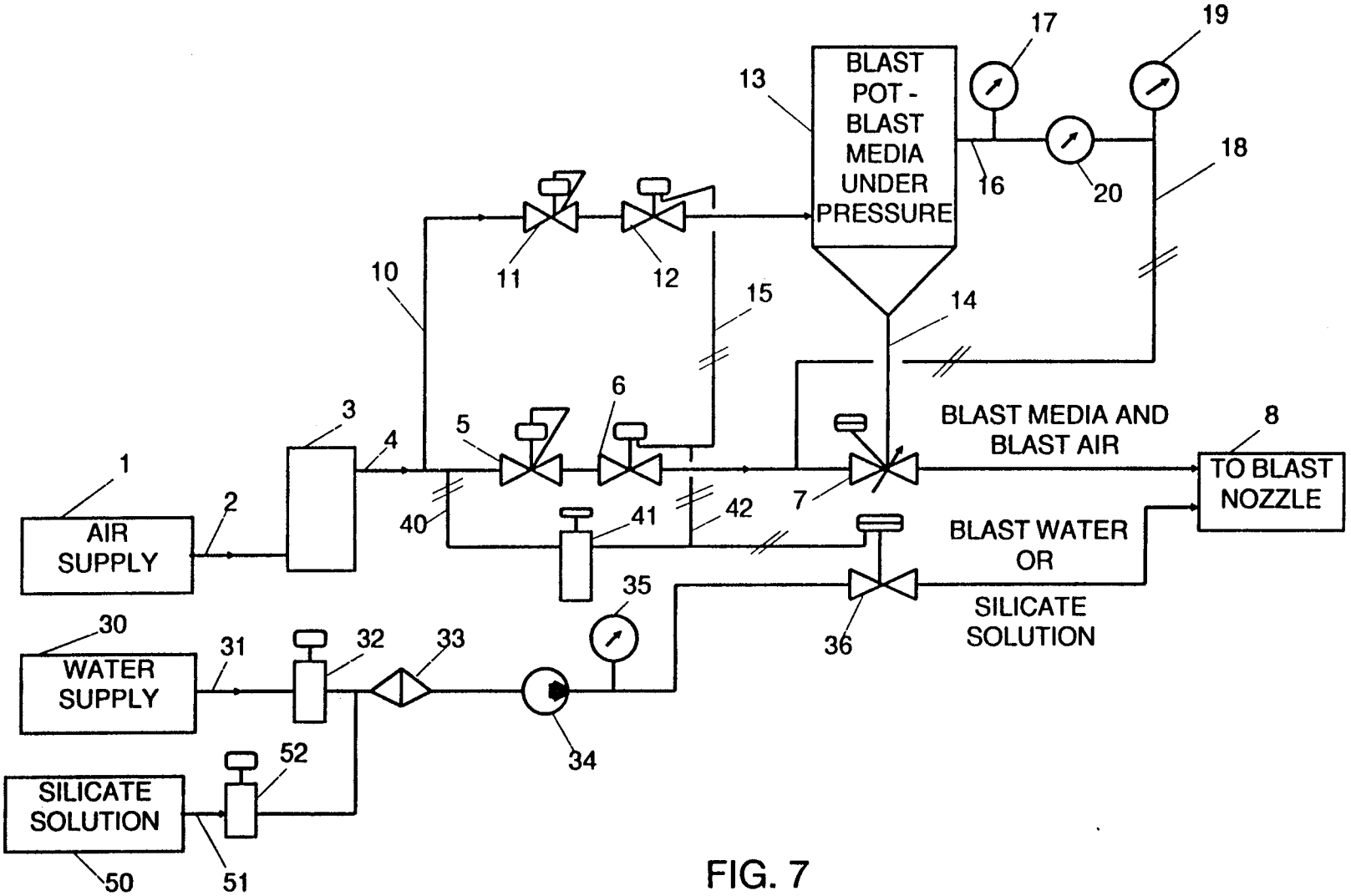
FIG. 7 is a flow diagram of a modified ACCUSTRIP® system that may be used in the blasting process of the invention utilizing the blast cleaning system of the invention.

A particularly preferred apparatus for blasting the cleaning systems of the invention onto airplane surfaces is a modification of the ACCUSTRIP ® System manufactured by Schmidt Manufacturing, Inc. of Houston, Tex. Details of the ACCUSTRIP ® System are provided in that company's ACCUSTRIP ® System Operating and Maintenance Manual," which is incorporated herein by reference. FIG. 7 is a flow diagram of a modified ACCUSTRIP ® system that may be used in the blasting process of the invention utilizing the blast cleaning system of the invention.

Briefly, in FIG. 7, pressurized air supply 1 is delivered by conduit 2 to moisture separator 3. After the moisture is separated from the air, the air is then delivered by conduit 4 to blast air regulator 5 and from there to blast air on/off valve 6. From there, it is delivered to Thompson valve 7 and thence through 8 to the blast nozzle, which is not shown.

Branching from conduit 4 carrying air after it leaves moisture separator 3 is conduit 10. Conduit 10 delivers some of the air stream to pot pressure regulator 11, from there to pot pressure on/off valve 12, and finally to blast pot 13, which is partially filled with ARMEX ® blast medium under pressure. The air pressure in blast pot 13 forces the ARMEX ® blast medium through conduit 14 to Thompson valve 7, which mixes the ARMEX ® blast medium with the air coming through the Thompson valve 7 from pressurized air supply 1. The ARMEX ® blast medium is entrained in the air and blasted through the blast nozzle by the pressurized air supply 1.

Pneumatic control line 15 connects blast air on/off valve 6 and pot pressure on/off valve 12. Pneumatic control line 15 functions to allow blast air on/off valve 6 to control pot pressure on/off valve 12.

Pneumatic control line 18 branches from conduit 4 at a point between blast air on/off valve 6 and Thompson valve 7. Blast pressure gauge 19 indicates the pressure at that point. Pot pressure gauge 17 indicates the pressure in conduit 16 which is connected to the blast pot 13. Pneumatic control line 16 has an in-line differential pressure gauge 20, which indicates the pressure differential between pot pressure gauge 17 and blast pressure gauge 19.

Water supply 30 is delivered by conduit 31 to on/off water control valve 32 and from there to strainer 33, which strains out any particles that might be in the water. Then the water is delivered to pump 34, after which it is delivered past water pressure gauge 35 to water valve 36. From there, the water is delivered through 8 to the blast nozzle, which is not shown.

Branching off conduit 4 is pneumatic control line 40 which has an in-line on/off control 41. Branching off pneumatic control line 15 is pneumatic control line 42 which connects with pneumatic control line 40 after on/off control 41. From that point, pneumatic control line 40 continues and is connected to water valve 36.

The silicate solution 50 is delivered by conduit 51 to in-line on/off silicate control valve 52 and from there to conduit 31 at a point between on/off water control valve 32 and strainer 33.

The system uses automatic normally closed controls. However, by appropriately opening or closing on/off water control valve 32, on/off control 41, or on/off silicate control valve 52, one can operate the apparatus in accordance with the process of the invention.

Nozzle pressures will vary depending on thickness and composition of material. Suggested nozzle pressures for aluminum structures are as follows:

| Metal Thickness (in.) | Nozzle Pressure | Media |
|---|---|---|
| .040 | 60 PSI | Aviation media-969011 |
| .030 | 50 PSI | Aviation media-969011 |
| .020 | 40 PSI | Aviation media-969011 |
| .010 | 30 PSI | Aviation media-969011 |

Blast angles will vary with the age of paint being removed and the design of the structure. As a general rule, one can start with the blast nozzle at an angle of 50° to 60° and 18 inches away from the structure as suggestions for the best overall angle and distance. Having generally described the invention, a more complete understanding can be obtained by reference to certain specific examples which are provided herein for purposes of illustration only and are not intended to limit the invention unless otherwise specified. All parts, percentages and proportions referred to herein and in the appended claims are by weight unless otherwise indicated.

Seven inhibitor solutions were tested for effectiveness. They are referred to by letters A to G and had the following compositions:

| Inhibitor Solution | Composition |
|---|---|
| A | A Nalco product containing silicates, borates and nitrites. |
| B | Witco 211 - aqueous amine solution of imazeline |
| C | 20% meta sodium silicate |
| D | 50% solution of sodium silicate |
| E | Solution of sodium borate and sodium metasilicate |
| F | Solution of sodium metasilicate and sodium nitrite. |
| G | 500 ppm sodium silicate having a 3.2 ratio of $SiO_2$:$Na_2O$ |

The compositions in Solutions A and B are commercially available products.

Solution D caused immediate gelling of the Armex ® test solution and was eliminated from further testing. The remaining solutions were corrosion tested using electrochemical techniques as outlined in Example 1. Corrosion rates were calculated from the slope of the plot. The corrosion current was calculated by multiplying the slope by a factor determined by the Tafel slopes. Faraday's law was then used to convert this current into a corrosion rate. ASTM Standard Recommended Practices G-3 and G-5 were used as guides.

Immersion testing was conducted as per Aerospace Recommended Practice 1512A and ASTM G-31. Corrosion rates were calculated by the following equation:

$$\text{Corrosion Rate} = (K \times W)/(A \times T \times D)$$

K = Constant
T = Time of exposure
A = Area of sample
W = Weight loss of sample
D = Density

EXAMPLE 1

Electrochemical Corrosion Tests

A. Introduction

Electrochemical techniques were used to determine the corrosion of 7075-T6 aluminum in sodium bicarbonate and sodium carbonate solutions. These techniques are based on current-voltage relationships between a metal specimen and the solution under study. The corrosion current developed by small voltage changes was measured and corrosion rates obtained. Also scans of current flow caused by incremental changes in applied voltage were obtained. The configuration of the curves indicated corrosion behavior. These techniques permit rapid corrosion rate measurements and offer monitoring capability. Tafel Plots and Polarization Resistance techniques were used.

B. Experimental

1. Test Apparatus:

The standard test cell was a 1000 ml six neck polarization flask. The aluminum test specimen (working electrode) was cylindrical, 1.59 cm long and 1.27 cm in diameter with a Teflon ® compression gasket to avoid crevice effects. The 7075 aluminum had a chemical composition of Si=0.11%, Fe=0.23%, Cu=1.54%, Mn=0.04%, Mg=2.73%, Cr=0.23%, Zn=5.87%, Ti=0.04%, Al=remainder.

Electrochemical measurements were obtained with standard potentiostatic techniques using a Princeton Applied Research Model 773 potentiostat, logarithmic current converter, universal programmer with slow sweep option and recorder. The apparatus was assembled as described in Princeton Applied Research "Application Note Corr 2". Two carbon counter electrodes were used. A saturated calomel reference electrode was utilized. Most tests were conducted at 49° C. (120° F.) with a continuous air purge after 8.5 hours.

2. Tafel Plot:

Tafel plots were obtained which established that the sodium bicarbonate/carbonate system fell within the assumptions of the Pourbaix criteria for the validity of the polarization resistance technique.

3. Polarization Resistance:

Polarization Resistance Measurements were obtained by scanning ±25 mv about the open circuit potential (E corr) at a rate of 0.1 mv/sec. Corrosion rates were calculated from the slope of the plot. The corrosion current is calculated by multiplying the slope by a factor determined by the Tafel slopes. Faraday's Law is then used to convert this current into a corrosion rate using the area of the specimen and equivalent weight factor for the particular alloy being studied.

C. Results

Tests were conducted on aluminum 7075-T6 in the following solutions after 8.5 hours exposure at 49° C. Steady state conditions were achieved after 8.5 hours. Corrosion rates were calculated from Polarization Resistance Curves and are listed in Table 1 and graphed in FIG. 1.

TABLE 1

| Solution | Composition | Corrosion Rate (Mils/Year) |
|---|---|---|
| A | 1.0% Sodium Bicarbonate | 0.5 |
| B | 10.0% ARMEX Blast Medium | 0.5 |
| C | 10.0% ARMEX Blast Medium | 0.5 |
| D | 7.5% Sodium Bicarbonate<br>3.1% Sodium Carbonate | 1.8 |
| E | 7.5% Sodium Bicarbonate<br>3.1% Sodium Carbonate<br>1.0% Sodium Hydroxide | 2.7 |
| F | 5.0% Sodium Bicarbonate<br>6.2% Sodium Carbonate | 3 |
| G | 2.5% Sodium Bicarbonate<br>9.3% Sodium Carbonate | 5 |
| H | 12.3% Sodium Carbonate | 26.4 |
| I | 2.0% Phosphoric Acid | 653 |

D. Discussion and Conclusions

1. All polarization plots show classic passive behavior for aluminum. A significant active/passive nose was not seen.

2. This electrochemical study confirmed the low corrosion rates, 0.5 mpy, obtained by earlier immersion testing with sodium bicarbonate solutions. A 12.3% sodium carbonate solution revealed a rate of 26.4 mpy in this test. However, mixtures of sodium bicarbonate and sodium carbonate, even a 25% $NaHCO_3$–75% $Na_2CO_3$, had rates of 2–5 mpy. Although sodium bicarbonate will decompose a few percent at ambient temperature, the products of decomposition include sodium sesquicarbonate ($Na_2CO_3.NaHCO_3 2H_2O$), which has pH buffering capacity. This probably accounted for the low corrosion rates obtained with these mixtures. Even when 1% sodium hydroxide was added to the solution, corrosion did not increase.

3. An extremely high corrosion rate, 653.0 mpy was obtained, as expected, with phosphoric acid.

4. The addition of 0.5% of a 41° Be sodium silicate solution reduced the corrosion of 12.3% sodium carbonate 88%.

EXAMPLE 2

Armex® Sodium Bicarbonate Blast Medium Integrity on Aluminum Surfaces

Introduction

Test data on the integrity of aluminum surfaces in sodium bicarbonate solutions was developed. Three types of testing were utilized: electrochemical corrosion testing, immersion testing as per ASTM F-483 and sandwich testing as per SAE Aerospace Recommended Practice 1512A.

Results of this testing showed sodium bicarbonate to have a low corrosion rate of 0.5 mpy (mils per year) at 120° F. Good correlation was obtained among the three test methods. For comparison, phosphoric acid, sodium carbonate, acetic acid and sodium chloride solutions were immersion tested. All had higher rates than sodium bicarbonate. The buffering capacity of sodium bicarbonate was shown to be large. Although sodium bicarbonate will decompose a few percent with time and temperature, sodium sesquicarbonate is formed which has great pH buffering capacity. Even a 50% sodium bicarbonate/sodium carbonate mixture had a low rate of 3 mpy.

Experimental Procedure and Results

Some users of Armex® sodium bicarbonate blast media have observed a staining effect on test panels which is cosmetically undesirable. Recent work has been completed to identify an appropriate inhibitor to eliminate this discoloration, lower corrosion, and at the same time greatly reduce the corrosion in other solutions including sodium carbonate.

Six candidate inhibitor systems were investigated. Various combinations of silicates, borates, nitrites and organic inhibitors known to inhibit aluminum were tested at 120° F. All six inhibitors lowered the corrosion rate of 1% and 10% Armex, with Inhibitor G having the largest rate reduction (94%).

Solid sodium bicarbonate at high temperatures will decompose into sodium carbonate and carbon dioxide. The six candidate inhibitor systems were tested in 1% and 10% sodium carbonate. Again, Inhibitor G exhibited an effective large rate reduction (99%).

Immersion and sandwich testing were conducted on inhibited (Inhibitor G) sodium bicarbonate, inhibited sodium carbonate and comparative solutions. Immersion testing as per ASTM F-483 at 160° F. showed the two inhibited solutions to have the lowest rates of all solutions tested—including tap water and distilled water. Samples subjected to phosphoric acid, Mil-R-81903 acid stripper and sodium chloride pitted severely.

Sandwich testing conducted as per ARP 1512 revealed no corrosion or staining of the aluminum with inhibited sodium bicarbonate or sodium carbonate.

Samples of aluminum 7075, 2024 and 7075 ALC were immersion tested for one year at 120° F. in 1% and 10% Armex. Corrosion rates were not measurable after this exposure.

SUMMARY

This work has shown that an effective inhibitor system has been identified for Armex ® blast media. Electrochemical, immersion and sandwich testing in inhibited solutions has shown a 94% reduction of corrosion rates at 160° F. and no staining of aluminum 7075, 2024 and 7075 ALC.

Sodium carbonate is also effectively inhibited with a rate reduction of 99% and no staining of aluminum 7075, 2024 and 7075 ALC.

One year immersion samples at 120° F. in Armex solutions had negligible corrosion.

TABLE 2

| Solution | Composition | Corrosion Rate (Mils/Year) |
|---|---|---|
| A | 1% ARMEX Blast Medium | 0.5 |
| B | 1% ARMEX Blast Medium 500 ppm Inhibitor A | 0.2 |
| C | 1% ARMEX Blast Medium 500 ppm Inhibitor B | 0.15 |
| D | 1% ARMEX Blast Medium 500 ppm Inhibitor C | 0.03 |
| E | 1% ARMEX Blast Medium 500 ppm Inhibitor E | 0.03 |
| F | 1% ARMEX Blast Medium 500 ppm Inhibitor F | 0.2 |
| G | 1% ARMEX Blast Medium 500 ppm Inhibitor G | 0.01 |
| H | Synthetic Tap Water - ASTM D1193 | 2 |
| I | Distilled Water | 1.2 |

Figure 2:
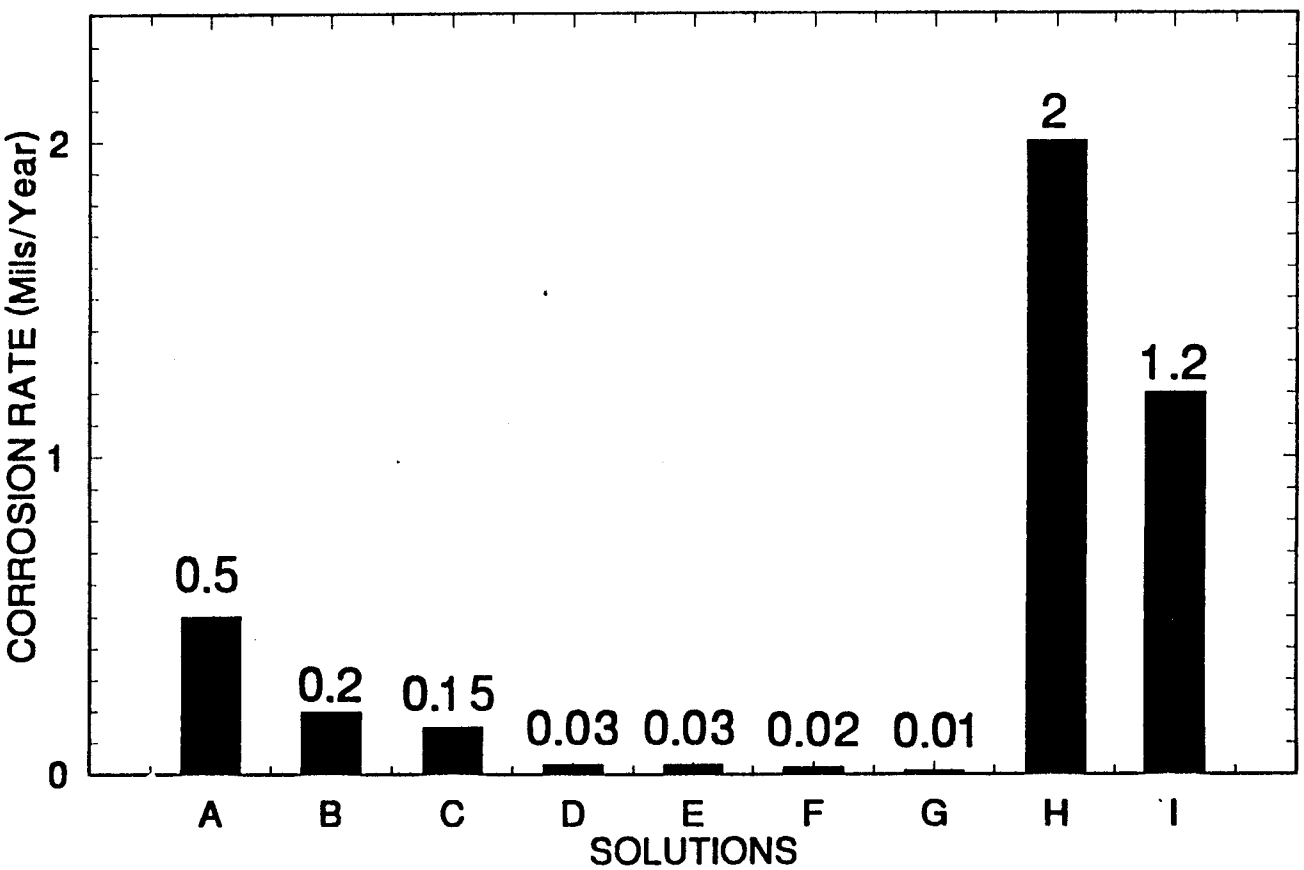
FIG. 2 shows the inhibition of corrosion rates of aluminum 7075-T6 alloy immersed in 1% aqueous solutions of blast media containing several compounds as inhibitors at 49° C. (120° F.).

FIG. 2 graphically shows the inhibition of corrosion rates of aluminum 7075-T6 alloy immersed in 1% aqueous solutions of ARMEX blast medium containing several compounds as inhibitors at 49° C. (120° F.).

TABLE 3

| Solution | Composition | Corrosion Rate (Mils/Year) |
|---|---|---|
| A | 10% ARMEX Blast Medium | 0.6 |
| B | 10% ARMEX Blast Medium 500 ppm Inhibitor A | 0.3 |
| C | 10% ARMEX Blast Medium 500 ppm Inhibitor B | 0.2 |
| D | 10% Sodium Bicarbonate 500 ppm Inhibitor C | 0.2 |
| E | 10% Sodium Bicarbonate 500 ppm Inhibitor E | 0.1 |
| F | 10% Sodium Bicarbonate 500 ppm Inhibitor F | 0.06 |
| G | 10% Sodium Bicarbonate 500 ppm Inhibitor G | 0.02 |
| H | Synthetic Tap Water - ASTM D1193 | 2 |
| I | Distilled Water | 1.2 |

Figure 3:
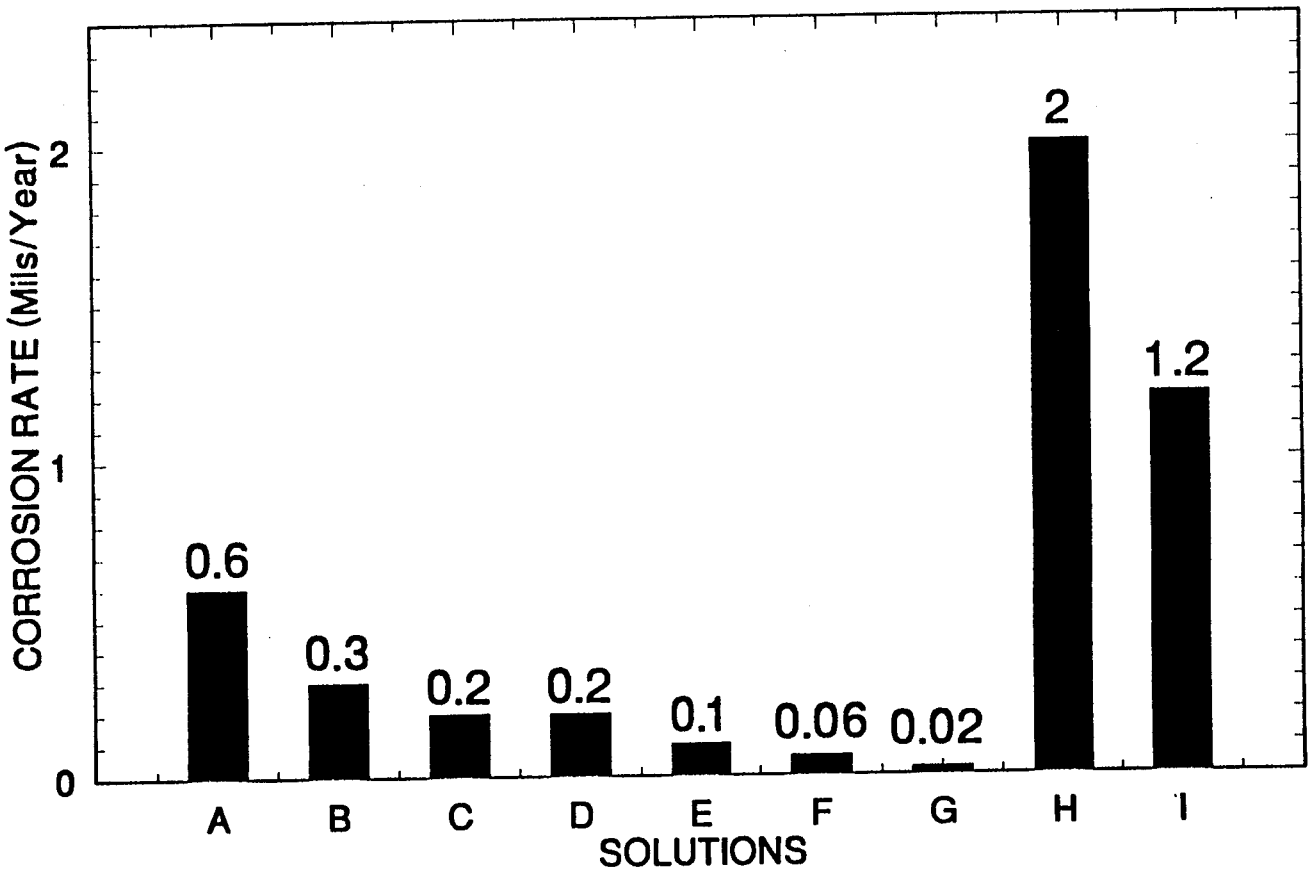
FIG. 3 shows the inhibition of corrosion rates of aluminum 7075-T6 alloy immersed in 10% aqueous solutions of blast media containing several compounds as inhibitors at 49° C. (120° F.).

FIG. 3 graphically shows the inhibition of corrosion rates of aluminum 7075-T6 alloy immersed in 10% aqueous solutions of blast medium containing several compounds as inhibitors at 40° C. (120° F.).

TABLE 4

| Solution | Composition | Corrosion Rate (Mils/Year) |
|---|---|---|
| A | 1% Sodium Carbonate | 19.5 |
| B | 1% Sodium Carbonate 500 ppm Inhibitor A | 5.5 |
| C | 1% Sodium Carbonate 500 ppm Inhibitor B | 13.6 |
| D | 1% Sodium Carbonate 500 ppm Inhibitor C | 33.4 |
| E | 1% Sodium Carbonate 500 ppm Inhibitor E | 11.6 |
| F | 1% Sodium Carbonate 500 ppm Inhibitor F | Test Discontinued - Developed Foam |
| G | 1% Sodium Carbonate 500 ppm Inhibitor G | 0.03 |
| H | Synthetic Tap Water - ASTM D1193 | 2 |
| I | Distilled Water | 1.2 |

Figure 4:
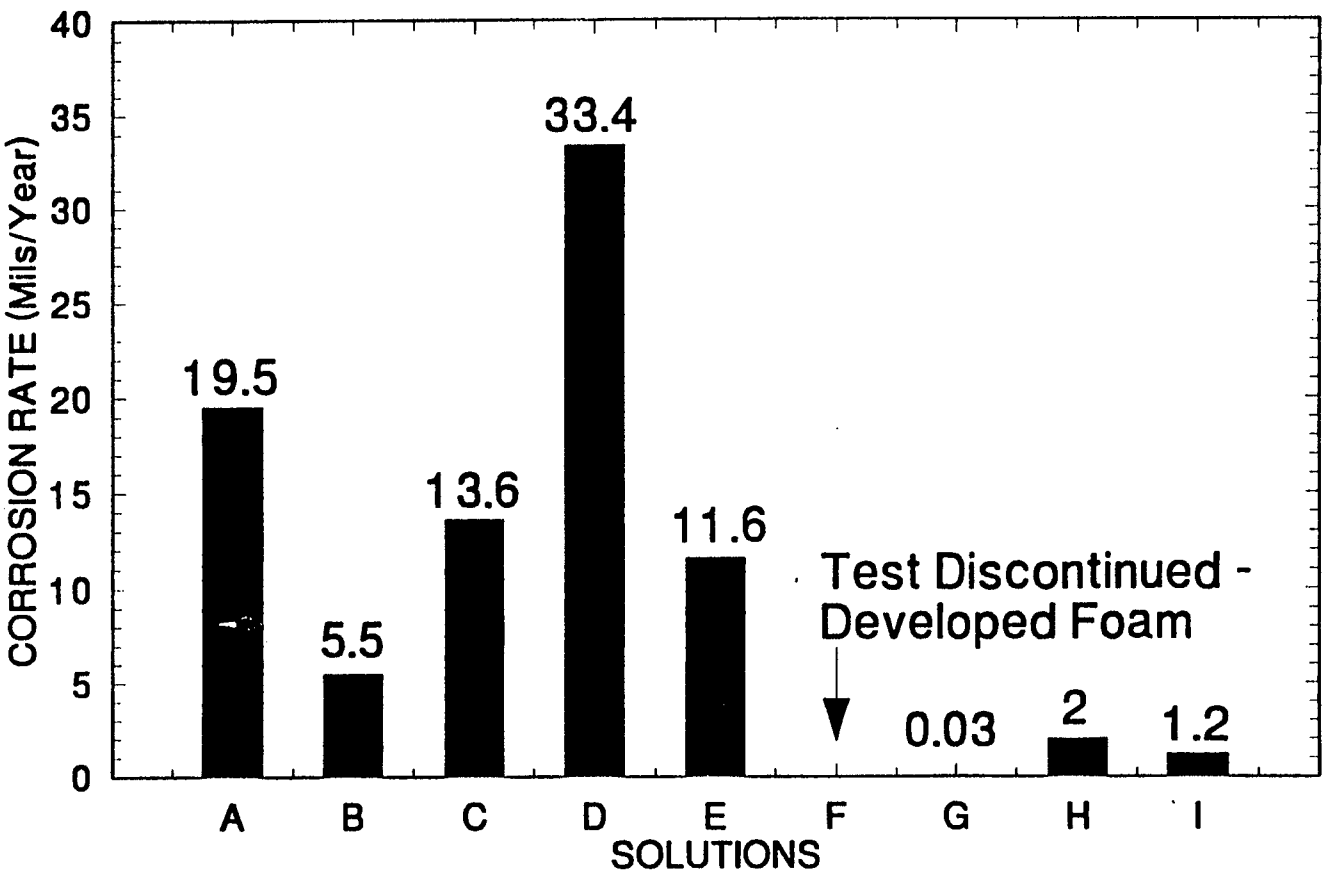
FIG. 4 shows the inhibition of corrosion rates of aluminum 7075-T6 alloy immersed in 1% aqueous solutions of sodium carbonate containing several compounds as inhibitors at 49° C. (120° F.).

FIG. 4 graphically shows the inhibition of corrosion rates of aluminum 7075-T6 alloy immersed in 1% aqueous solutions of sodium carbonate containing several compounds as inhibitors at 49° C. (120° F.).

TABLE 5

| Solution | Composition | Corrosion Rate (Mils/Year) |
|---|---|---|
| A | 10% Sodium Carbonate | 26.4 |
| B | 10% Sodium Carbonate 500 ppm Inhibitor A | 7.4 |
| C | 10% Sodium Carbonate 500 ppm Inhibitor B | 14 |
| D | 10% Sodium Carbonate 500 ppm Inhibitor C | 65.1 |
| E | 10% Sodium Carbonate 500 ppm Inhibitor E | 12.3 |
| F | 10% Sodium Carbonate 500 ppm Inhibitor F | Test Discontinued - Developed Foam |
| G | 10% Sodium Carbonate 500 ppm Inhibitor G | 0.03 |
| H | Synthetic Tap Water - ASTM D1193 | 2 |
| I | Distilled Water | 1.2 |

Figure 5:
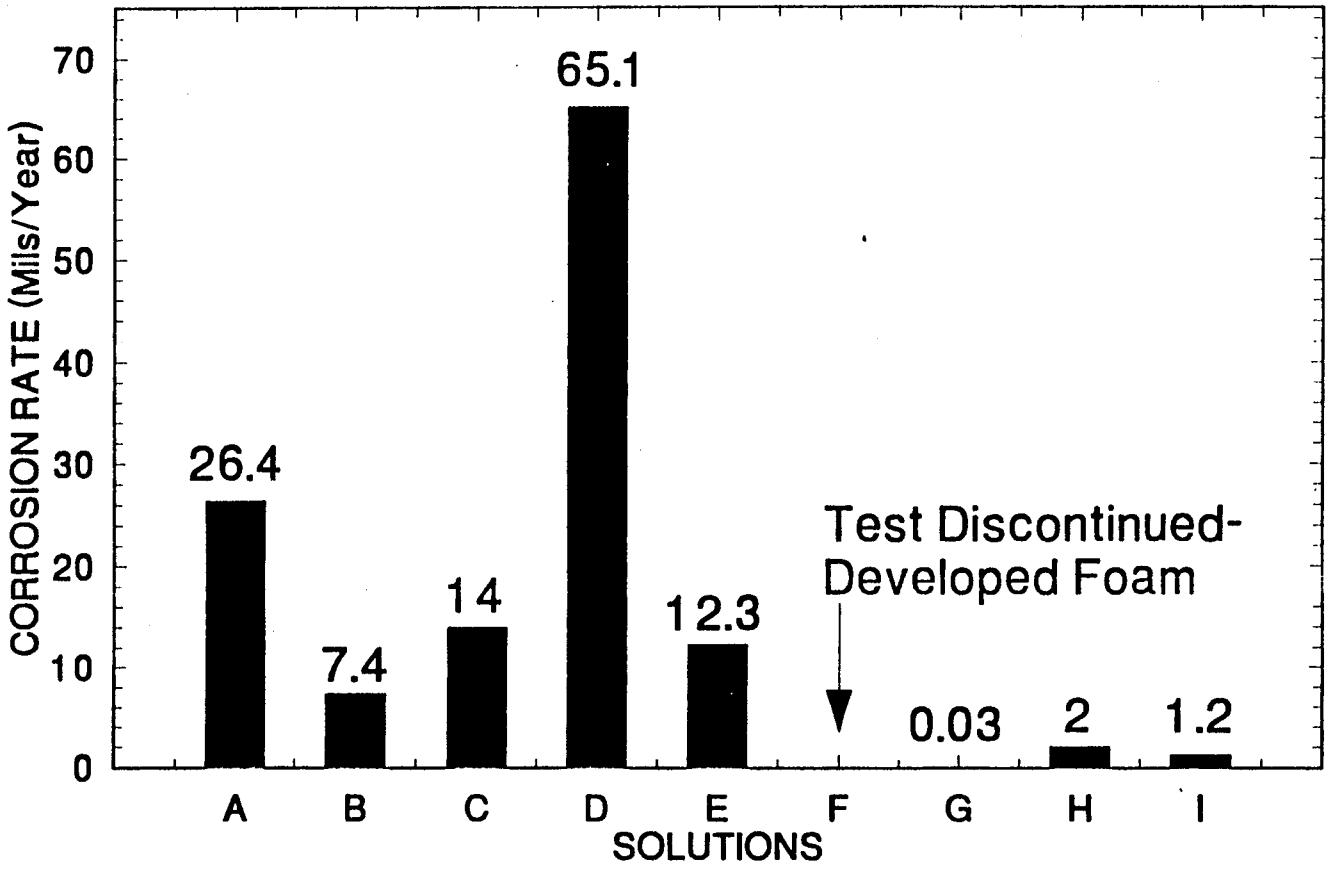
FIG. 5 shows the inhibition of corrosion rates of aluminum 7075-T6 alloy immersed in 10% aqueous solutions of sodium carbonate containing several compounds as inhibitors at 49° C. (120° F.).

FIG. 5 graphically shows the inhibition of corrosion rates of aluminum 7075-T6 alloy immersed in 10% aqueous solutions of sodium carbonate containing several compounds as inhibitors at 49° C. (120° F.).

TABLE 6

| Solution | Composition | Corrosion Rate (Mils/Year) |
|---|---|---|
| A | 1% Phosphoric Acid | 67.4 |
| B | 1% & 10% Sodium Carbonate | 57.3 |
| C | Acid Stripper | 4.9 |
| D | 2% Sodium Chloride | 3.2 |
| E | Alkaline Stripper | 3.1 |
| F | Synthetic Tap Water - ASTM D1193 | 2.8 |
| G | Distilled Water | 1.8 |
| H | 1% & 10% ARMEX Blast Medium | 0.5 |
| I | 1% & 10% Sodium Carbonate 500 ppm Inhibitor G | 0.4 |
| J | 1% & 10% ARMEX Blast Medium 500 ppm Inhibitor G | 0.03 |

Figure 6:
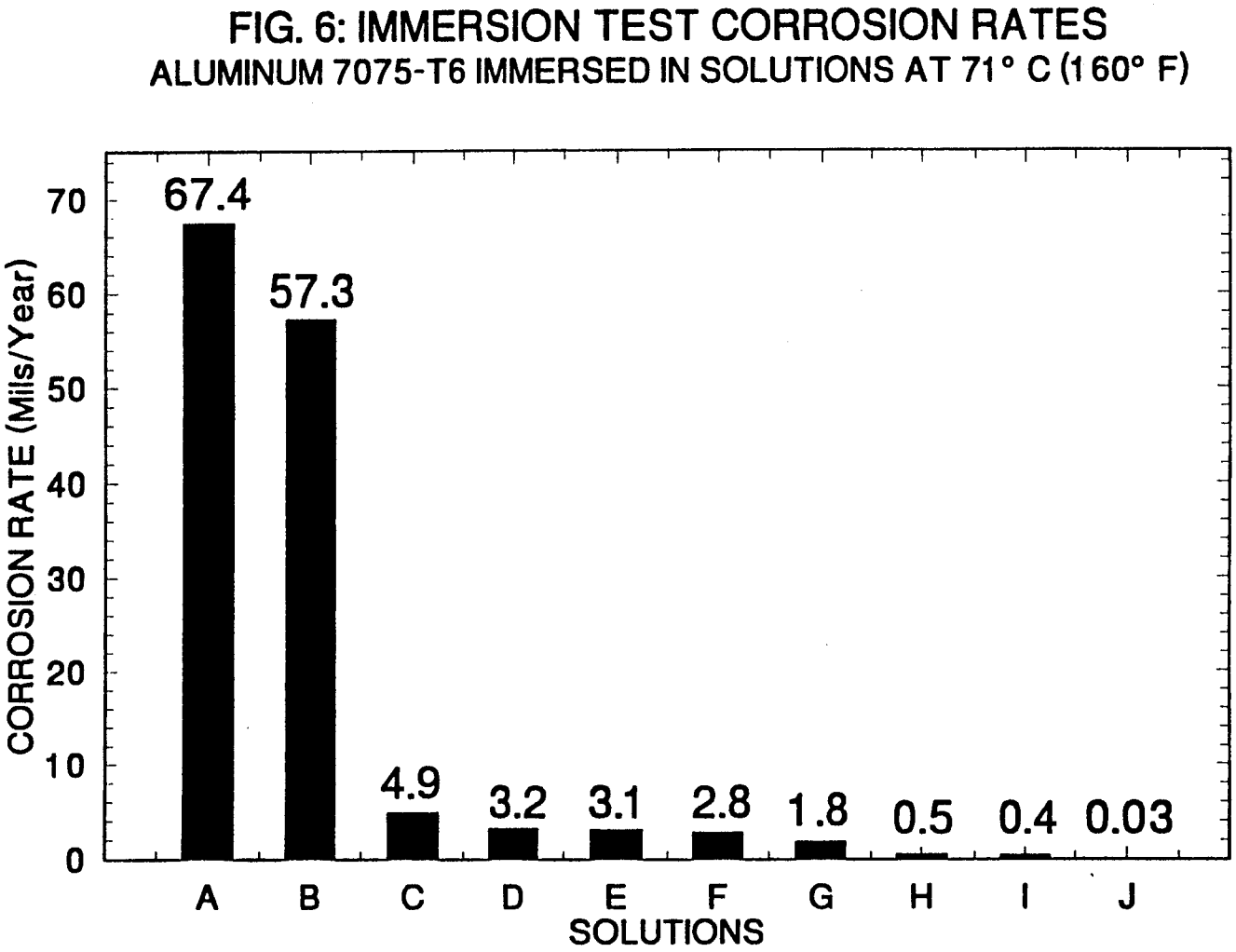
FIG. 6 shows the immersion test corrosion rates for aluminum 7075-T6 alloy in a number of solutions at 71° C. (160° F.) and illustrates the effectiveness of the sodium silicate inhibitor used in the invention.

FIG. 6 graphically shows the immersion test corrosion rates for aluminum 7075-T6 alloy in a number of solutions at 71° C. (160° F.) and shows the effectiveness of the sodium silicate inhibitor used in the invention.

EXAMPLE 3

Tests of Armex ® Sodium Bicarbonate Blast Medium on the Integrity of Metal Surfaces

Introduction

The Armex ® blasting system delivers the abrasive sodium bicarbonate, supplied by Church & Dwight Company, Inc., to the work surface by means of a controlled forced air system. Water is injected into the stream to keep dust to a minimum. Sodium bicarbonate is an odorless, non-flammable, nonsparking, water-soluble material widely used in food and pharmaceutical applications. Most recognize it in the yellow box that is supposed to be in every refrigerator in America or as a major ingredient in Toll House cookies.

Metal Surface Stability

Initial data on metal surface stability of Armex® Blast Medium was obtained with aluminum 7075-T6 and 2024-T6. Various chemical cleaning solutions and chemical environments were compared with uninhibited and inhibited Armex®. Uninhibited corrosion rates were low and inhibited rates even lower; almost five times lower than distilled water. Visual inspection of Sandwich Corrosion Testing as per Aerospace Recommended Practice 1512A showed good results when compared with distilled water. A one year exposure at 120° F. produced no measurable corrosion.

Recent work has been completed by a recognized independent testing laboratory. Total Immersion Corrosion Test, Low-Embrittling Cadmium Plate Test, Hydrogen Embrittlement Test and Corrosion Sandwich Test were conducted in accordance with recognized test methods from ASTM and ARP.

Data developed using Aerospace Matl. Spec. 1375 Total Immersion Corrosion Test showed Armex® medium conforming to specifications for all metals specified for testing; aluminum, anodized aluminum, titanium, steel and magnesium. Armex® medium was a factor of 10 lower than the specified limits.

AMS 1375 Low-Embrittling Cadmium Plate Test was used to evaluate Armex® medium. Armex® conforms to this specification.

Hydrogen Embrittlement Testing was conducted as per ASTM-F-519 using Type 1c 4340 steel samples. All samples passed this test.

ARP 1512A Corrosion Sandwich Test compared Armex® medium with synthetic tap water on aluminum 2024-T3, 2024-ALC, 7075-T6 and 7075-ALC. All samples were rated (1) for conformity to this test.

Next, Boeing Specification D6-17487J was used to evaluate Armex® medium. This Sandwich Corrosion Test uses distilled water as the comparative in the test. Aluminum 7075-T6 and aluminum 7075 anodized were rated (1) in both distilled water and Armex®.

The Boeing Immersion Corrosion Test specifies aluminum, steel, cadmium plated steel, titanium and magnesium to be tested. Armex® was almost 5 times lower than the specified limits on all materials.

Comparative Fatigue Strength of Alclad 2024-T3 Specul-Air samples painted stripped by PMB (Plastic Media Blast from DuPont), chemical means and Armex® were developed. None of the paint stripping treatments lowered the fatigue strength.

TABLE 7

Total Immersion Corrosion test - ASTM F-483
Aerospace Matl. Spec. 1375
1% Inhibited ARMEX ® Blast Media

| | Limit mg/cm²/24h | Found mg/cm²/24h |
|---|---|---|
| Aluminum 2024 T-3 | 0.4 | 0.04 |
| Aluminum 7075 Anod. | 0.4 | 0.02 |
| Aluminum 7075 Anod. | 0.4 | 0.07 |
| Aluminum 7075 Anod. | 0.4 | 0.02 |
| Titanium 6AI4V | 0.1 | 0.01 |
| Steel 1010 | 1.0 | 0.06 |
| Magnesium AZ31B | 0.8 | 0.14 |

ARMEX ® Conforms to AMS 1375

TABLE 8

Low-Embrittling Cadmium Plate - ASTM FIIII
Aerospace Matl. Spec. 1375
1% Inhibited ARMEX ® Blast Media

| | Limit mg/cm²/24h | Found mg/cm²/24h |
|---|---|---|
| Cadmium Plate | 0.4 | 0.14 |

ARMEX ® Conforms to AMS 1375

TABLE 9

Hydrogen Embrittlement Test - ASTM-519

Type 1c AISI 4340 Steel
1% Inhibited ARMEX ® - Pass on All Specimens

TABLE 10

Corrosion Sandwich Test - ARP 1512A
Aerospace Recommended practice

| | Aluminum Alloys | | | |
|---|---|---|---|---|
| | 2014-T3 | 2024-ALC | 7075-T6 | 7075-ALC |
| 1% Inhibited ARMEX ® | 1 | 1 | 1 | 1 |
| Synthetic Tap Water | 1 | 1 | 1 | 1 |

ARMEX ® Rates Same (1) as Tap Water
Conforms to ARP 1512A

TABLE 11

Boeing D6-17487 J
1% & 5% Inhibited ARMEX ® Blast Media
A. Sandwich Corrosion Test

| | Aluminum Alloys | |
|---|---|---|
| | 7075-T6 | 7075-Anod |
| 1% Inhibited ARMEX ® | 1 | 1 |
| 5% Inhibited ARMEX ® | 1 | 1 |
| Distilled Water | 1 | 1 |

ARMEX ® Rated Same (1) as Distilled Water
ARMEX ® Conforms to Boeing D6-17487 J

TABLE 12

Boeing D6-17487 J
1% & 5% Inhibited ARMEX ® Blast Media
B. Immersion Corrosion Test

| | Limit | Found |
|---|---|---|
| Aluminum | ±10 mg | ±1.6 mg |
| 4130 Steel | ±30 mg | ±3.9 mg |
| Cadmium Plated Steel | ±10 mg | ±2.9 mg |
| Titanium | ±10 mg | ±0.9 mg |
| Magnesium | ±20 mg | ±1.6 mg |

ARMEX ® Confroms to Boeing D6-17487 J

TABLE 13

Fatigue Strength Comparison
Fatigue strength was obtained on Alclad 2024-T3 Specul-Air sheet after paint was stripped by the following media:

| | |
|---|---|
| Chemical | (commerical cleaning and stripping compound) |
| PMB | (Plastic Media Blast from DuPont) |
| ARMEX ® | Coarse |
| ARMEX ® | Fine |

Tested on a 25 Hz Krouse fatigue machine.
None of the paint stripping treatments lowered the fatigued strength.

EXAMPLE 4

Armex Solution Bicarbonate Blast Medium Blasted on Aluminum Surfaces

Fabricated panels of aluminum alloy 7075-T6 that had been painted are blasted with ARMEX Blast Medium with prior, concurrent and subsequent spraying of aqueous solutions comprising 500 ppm sodium silicate. The panels are then repainted and subjected to humidification/dehumidification and salt spray cycles. After a month of treatment, the panels with fasteners are evaluated for corrosion. The entire process is repeated two more times. There is no deleterious corrosion of the panels, and the new paint adheres to the panels after repainting.

Composite panels were also similarly evaluated for structural damage. Again, there was no deleterious effect on the composite panels.

The process of the invention has also been evaluated for decoating composite structures, such as radomes and control sections. The process is superior to hand-sanding in production rate and surface appearance.

EXAMPLE 5

Armex Solution Bicarbonate Blast Medium Blasted on Aircraft Aluminum Surfaces Surfaces of airplanes that had been painted are first prewashed, then are blasted with ARMEX Blast Medium with prior, concurrent and subsequent spraying of aqueous solutions comprising 500 ppm of sodium silicate. The cleaned surfaces of the airplanes are rinsed with a suitable solvent, then washed free of the residue and solvent, and dried and repainted. The paint adheres to the cleaned surfaces with no apparent problems.

The foregoing description and examples illustrate selected embodiments of the present invention and in light thereof variations and modifications will be suggested to one skilled in the art, all of which are within the spirit and purview of this invention.

What is claimed is:

1. A process for cleaning aluminum surfaces without causing significant discoloring or tarnishing of the aluminum which comprises:

(a) using a pressurized fluid to blast an alkali metal bicarbonate to the aluminum surface to be cleaned, and (b) applying an aqueous alkali metal silicate solution to the aluminum surface, the sodium silicate having an $SiO_2$:$Na_2O$ ratio of from about 2.44 to about 3.22:1 and being present in the aqueous solution in a corrosion inhibiting concentration of from about 100 to about 1000 ppm., the pH of the solution ranging from about 8.1 to about 8.3.

2. A process according to claim 1 wherein there is an additional step:

(c) subsequently rinsing off the aluminum surfaces to remove the residual alkali metal bicarbonate, alkali metal silicate solution and any matter cleaned from the aluminum surfaces.

3. A process according to claim 1 wherein the alkali metal bicarbonate is lithium, sodium or potassium bicarbonate, the alkali metal silicate is sodium silicate, and the aluminum surfaces are rinsed to remove the residual alkali metal bicarbonate, sodium silicate solution and any matter cleaned from the aluminum surfaces.

4. A process according to claim 1 wherein a sodium silicate solution is applied to the aluminum surfaces to be cleaned prior to blasting the aluminum surfaces with the alkali metal bicarbonate.

5. A process according to claim 1 wherein a sodium silicate solution is applied to the aluminum surfaces to be cleaned simultaneously with the blasting of aluminum surfaces with the alkali metal bicarbonate.

6. A process according to claim 1 wherein a sodium silicate solution is applied to the aluminum surfaces to be cleaned after blasting the aluminum surfaces with the alkali metal bicarbonate.

7. A process as claimed in claim 1 wherein the alkali metal bicarbonate has particle sizes of from about 50 to about 1000 microns.

8. A process as claimed in claim 1 wherein the alkali metal bicarbonate has particle sizes of from about 250 to about 300 microns.

9. A process as claimed in claim 1 wherein the sodium silicate is present in the aqueous solution in a corrosion inhibiting concentration of from about 100 to about 300 ppm.

10. A process as claimed in claim 7 wherein the sodium silicate is present in the aqueous solution in a corrosion inhibiting concentration of from about 300 to about 1000 ppm.

11. A process for stripping paint from the exterior surface of an aircraft comprising the steps of:

(a) prewashing the surface with water or an aqueous solution of a detergent, (b) using a pressurized fluid to blast the alkali metal bicarbonate to the aluminum surface to be cleaned, (c) applying a sodium silicate solution to the aluminum surface, the sodium silicate having an $SiO_2$:$Na_2O$ ratio of from about 2.44 to about 3.22:1 and being present in the aqueous solution in a corrosion inhibiting concentration of from about 100 to about 1000 ppm, the pH of the solution ranging from about 8.1 to about 8.3, and (d) subsequently rinsing off the aluminum surfaces to remove the residual alkali metal bicarbonate, sodium silicate solution and any matter cleaned from the aluminum surfaces.

12. A process according to claim 11 wherein the method of conducting the blasting step (b) comprises the substeps of:

(i) containing within a pressure vessel a quantity of alkali metal bicarbonate blasting medium comprised of fine particles having a mean particle size of from about 50 to about 100 microns;

(ii) pressuring said pressure vessel by providing fluid communication between said pressure vessel and a source of pressurized air;

(iii) feeding said blasting medium from said pressure vessel through an exit conduit to a conveying conduit, said conveying conduit being in fluid communication with said source of pressurized air through an air conduit;

(iv) mixing said blasting medium with the stream of pressurized air flowing within said conveying conduit;

(v) sensing the pressure differential between said pressure vessel and said conveying conduit;

(vi) maintaining said pressure differential at a preselected level so that the pressure level within said pressure vessel is greater than the pressure within said conveying conduit; and (vii) discharging said mixture of blasting medium and said stream of pressurized air through a nozzle at the end of said conveying conduit.

* * * * *